United States Patent [19]

Rhoads

[11] Patent Number: 4,955,500

[45] Date of Patent: Sep. 11, 1990

[54] SEALING GROOVE COVER

[76] Inventor: John R. Rhoads, 23431 W. Peters Rd., Casa Grande, Ariz. 85222

[21] Appl. No.: 386,121

[22] Filed: Jul. 28, 1989

[51] Int. Cl.[5] ..... B65D 43/06

[52] U.S. Cl. ..... 220/212; 220/90; 220/266

[58] Field of Search ..... 220/212, 90, 266, 270

[56] References Cited

U.S. PATENT DOCUMENTS

| | | | |
|---|---|---|---|
| 2,873,881 | 2/1959 | Nichols | 220/90 |
| 3,469,735 | 7/1967 | Burt | 220/90 |
| 3,913,785 | 10/1975 | Pattershall | 220/354 |
| 4,009,802 | 3/1977 | Heyduchok | 222/108 |
| 4,150,763 | 4/1979 | Simpson | 220/90 |
| 4,203,537 | 5/1980 | McAlister | 222/570 |
| 4,240,568 | 12/1980 | Pool | 222/189 |
| 4,312,459 | 1/1982 | Leach | 220/90 X |
| 4,583,666 | 4/1986 | Buck | 222/109 |

*Primary Examiner*—Donald F. Norton
*Attorney, Agent, or Firm*—Cahill, Sutton & Thomas

[57] ABSTRACT

A sealing groove cover for a cylindrical fluid container includes a circular body, a circular outer sealing member, a circular inner sealing member and a circular male element. The outer sealing member is coupled to the circular body along its outer perimeter edge and snugly contacts the outer surface of the container wall. The circular inner sealing member is coupled to the circular body along its inner perimeter edge and is dimensioned to snugly contact the inner perimeter of a female groove which forms a part of the cylindrical container and is dimensioned to receive and seal with a removable lid. The circular male element of the sealing groove cover is located at a radial distance between the inner and outer sealing members and is aligned with the female groove of the container to form an interference fit between the sealing groove cover and the container female groove. The sealing groove cover prevents contaminating fluids or particulate matter from entering the female groove of the container when the lid is removed from the container.

20 Claims, 2 Drawing Sheets

SEALING GROOVE COVER

BACKGROUND OF THE INVENTION

1. Field of the Invention

This invention relates to accessories for cylindrical fluid containers, and more particularly, to sealing groove covers for cylindrical fluid containers having a circular female groove for sealing to a mated male element of a removable lid.

2. Description of the Prior Art

Typical cylindrical fluid containers, such as paint cans, include a removable circular lid having a circular male element disposed around its permimeter. The male element of the lid forms an interference fit with a mated female groove which extends around the interior perimeter of the container top.

The interference fit between the male element of the lid and the female groove of the container forms a fluid tight seal which can easily be resealed if the female groove of the container is maintained in a clean and dry state.

If the container female groove becomes partially filled with paint, it becomes difficult to reinsert the male element of the lid back into the female groove of the container. Under such circumstances, either resealing of the lid to the container is impossible or the imcompressible fluid remaining in the female groove is squirted out onto the user or onto an adjacent surface.

Alternatively, paint or some other volatile fluid typically stored in the container may dry and harden within the female groove. This condition either prevents reattachment of the lid to the container or forms a non-airtight, leaky seal between the lid and the container. The occurrence of either alternative enables air to circulate into the interior of the container and causes the volatile components of the fluid to evaporate. After a minimal period of time, the paint or other fluid disposed within the container becomes unusable and must be discarded.

If the lid is resealed to a container female groove which includes paint or another volatile fluid, part of that fluid evaporates and forms a glue-like bond between the lid and the female groove of the container which frequently either prevents removal of the lid from the container or causes damages to either the lid or the sealing female groove as a result of a user's attempt to remove the lid from the container.

SUMMARY OF THE INVENTION

It is therefore a primary object of the present invention to provide a sealing groove cover which can be installed immediately after the container lid has been removed and which covers both the container top and the sealing female groove to prevent contamination of the sealing structure of the container.

Yet another object of the present invention is to provide a sealing groove cover which includes a male element providing a fluid-tight, friction fit between the male element of the sealing groove cover and the female groove of the container.

Yet another object of the present invention is to provide a sealing groove cover formed as a segmented circle which includes a pull tab to facilitate easy removal of the cover from the container by a spiraling, lifting motion.

Yet another object of the present invention is to provide a sealing groove cover having a knock-out center piece which prevents the paint or other fluid situated within the container from being contaminated after the sealing groove cover is applied but before first use of the paint or other fluid disposed in the container.

Yet another object of the present invention is to provide a sealing groove center having a knock-out center piece with a substantially flat surface which can receive and display advertising text, a trademark or related printed or graphic material.

Yet another object of the present invention is to provide a sealing groove cover fabricated from a bendable plastic material permitting bending deformation of the cover to facilitate easy removal of the cover from the container.

Still another object of the present invention is to provide a sealing groove cover which can be installed as a flat or planar unit and which can be removed by a spiral pulling force exerted by the user on the pull tab.

Briefly stated, and in accord with one embodiment of the invention, a sealing groove cover is adapted for use on a cylindrical container having a center, an open top, a bottom and a vertically oriented cylindrical side wall with inner and outer surfaces. The container further includes a continuous circular female groove which is disposed within the container side walls and includes an outer perimeter coupled to the top of the side wall as well as an inner perimeter. The female groove serves to secure and seal a removable lid having a complementary circular male element to the top of the container. The sealing groove cover comprises a circular body fabricated from a bendable material. The circular body includes a first end, a second end terminating in proximity to the first end and defines a gap between the first and second ends. The circular body further includes an inner perimeter edge and an outer perimeter edge. A circular outer sealing member is fabricated from a bendable material and is coupled to the circular body along the outer perimeter edge. The outer sealing member is dimensioned to snugly contact the outer surface of the container side wall. A circular inner sealing member is fabricated from a bendable material and is coupled to the circular body along the inner perimeter edge. The inner sealing member is dimensioned to snugly contact the inner perimeter of the female groove. A circular male element is fabricated from a bendable material and projects outward from the circular body at a radial distance between the inner and outer sealing members in alignment with the female groove of the container. The male element forms an interference fit between the sealing groove cover and the container female groove. The body, the inner and outer sealing members and male element are capable of being deflected without breaking as the first and second ends of the circular body are displaced relative to each other by torsional forces. The sealing groove cover prevents contaminating fluids or particulate matter from entering the female groove of the container when the lid is removed from the container.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

Figure 1:
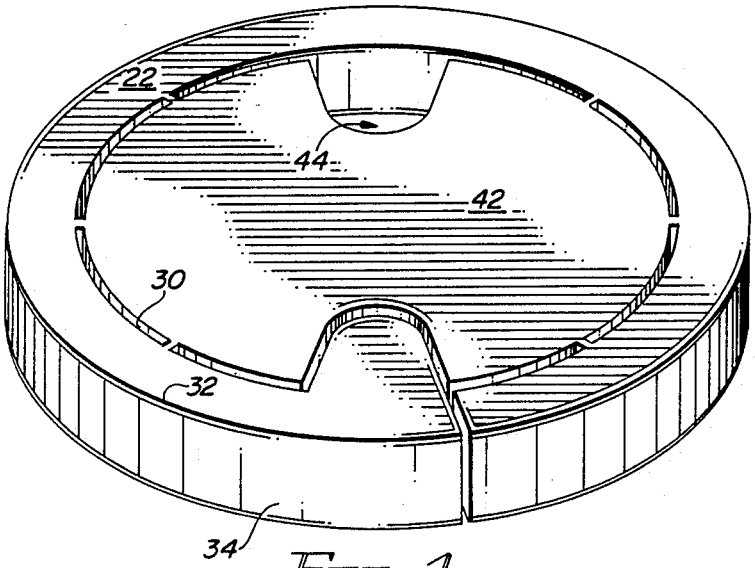
FIG. 1 represents a perspective view of the sealing groove cover of the present invention.

In order to better illustrate the advantages of the invention and its contributions to the art, a preferred hardware embodiment of the invention will now be described in some detail.

Referring now to FIGS. 1–4, a sealing groove cover 10 is dimensioned to be fitted to a cylindrical container 12 having a center, an open top, a bottom, and a vertically oriented cylindrical side wall 14 including inner and outer surfaces.

Cylindrical container 12 further includes a continuous circular female groove which is disposed within the container side walls. Female groove 16 includes an outer perimeter 18 which is coupled to the top of side wall 14. Female groove 16 also includes an inner perimeter 20. The structure of female groove 16 serves to secure and seal a removable, circular lid (not shown) having a complementary circular male element to the top of cylindrical container 12.

The sealing groove cover 10 of the present invention includes a circular body 22 fabricated from a bendable material. Circular body 22 includes a first end 24 and a second end 26 which terminates in proximity to first end 24 and defines a gap 28 between the first and second ends. Circular body 22 further includes an inner perimeter edge 30 and an outer perimeter edge 32. A circular outer sealing member 34 is fabricated from a bendable material and is coupled to circular body 22 along outer perimeter edge 32. Outer sealing member 34 is dimensioned to snugly contac the outer surface of container side wall 14.

A circular inner sealing member 36 is fabricated from a bendable material and is coupled to circular body 22 along inner perimeter edge 30. Inner sealing member 36 is dimensioned to snugly contact the inner perimeter 20 of female groove 16.

A circular male element 38 is fabricated from a bendable material and projects outward or downward from circular body 22 at a radial distance between inner sealing member 36 and outer sealing member 34. Male element 38 is aligned with female groove 16 of container 12 to form an interference fit between the sealing groove cover 10 and the container female groove 16.

Figure 6:
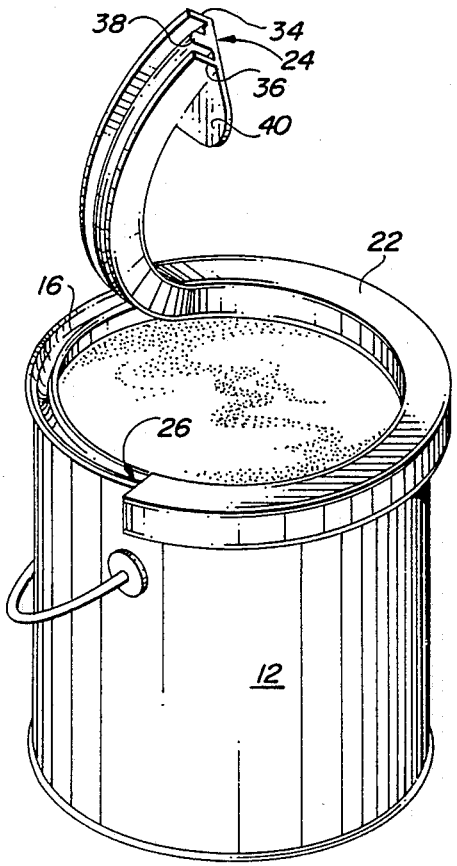
FIG. 6 represents a perspective view of the sealing groove cover as it is being removed by a spiraling, lifting motion from the female groove of a cylindrical paint container.

Circular body 22, inner sealing member 36, outer sealing member 34 and male element 38 are capable of being bent or deflected without breaking as the first end 24 and second end 26 of body 22 are displaced relative to each other by torsional forces as the sealing groove cover 10 is removed from container 12 as depicted in FIG. 6.

Figure 4:
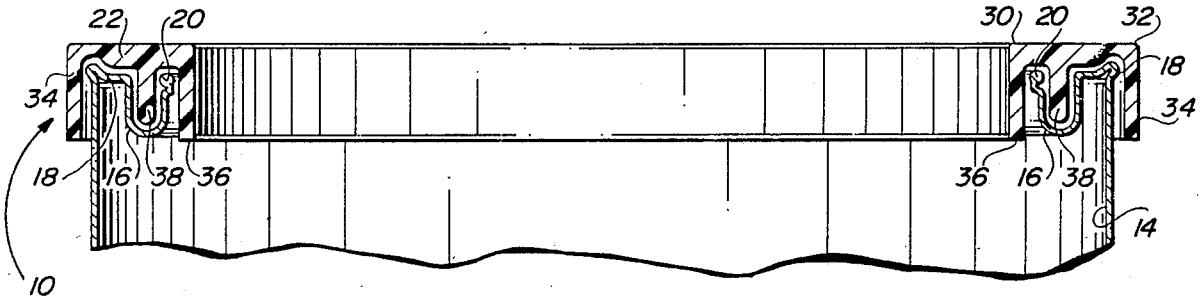
FIG. 4 represents a sectional view of the sealing groove cover depicted in FIG. 1, particularly illustrating the airtight, interference fit between the base of the sealing groove cover and the female groove of the top of the fluid container.

The structure and configuration of the sealing groove cover 10 of the present invention, particularly as illustrated in FIG. 4 where it is shown installed on the upper surface of a paint container, prevents contaminating fluids or particulate matter from entering the female groove 16 of container 12 when the lid is removed from the container.

The sealing groove cover of the present invention also may be configured to include a pull tab 40 as illustrated in the drawings which facilitates gripping and removal of the sealing groove cover from the container. Pull tab 40 is typically located in proximity to first end 20 of circular body 22.

Although pull tab 40 may be located at an elevation other than in alignment with the upper surface of circular body 22 and as well may be placed on the outer perimeter edge 32 rather than inner perimeter edge 30 as depicted or may even be positioned somewhat offset from either end 24 or 26 of the circular body, the location of pull tab 40 as illustrated in the drawings represents the preferred position.

Figure 2:
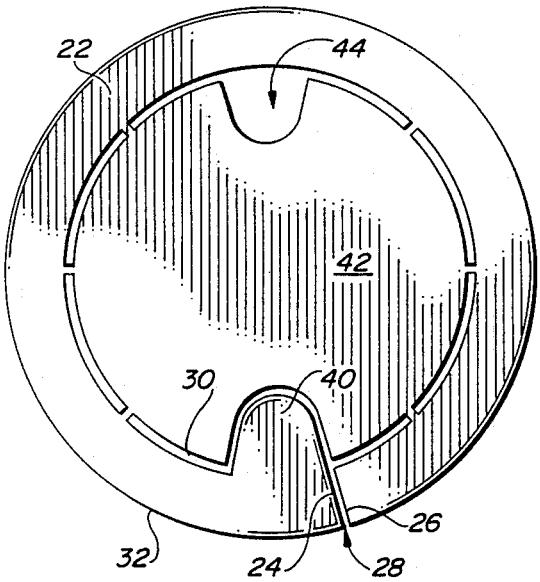
FIG. 2 represents a top elevational view of the sealing groove cover depicted in FIG. 1.
Figure 3:
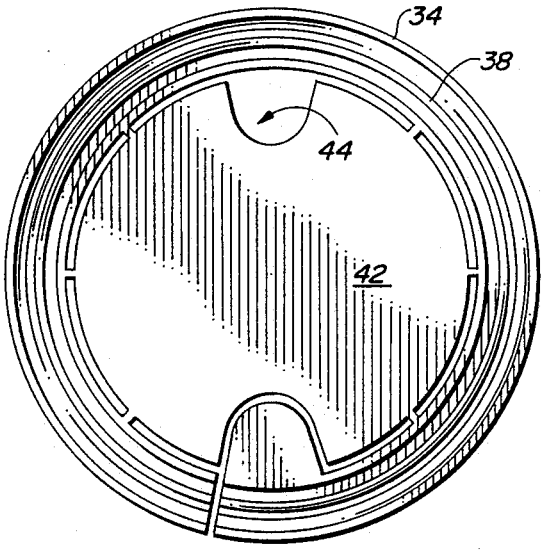
FIG. 3 represents a bottom elevational view of the sealing groove cover depicted in FIG. 1.

As illustrated in FIGS. 1, 2 and 3, the sealing groove cover 10 of the present invention may also be configured to include a knock-out center piece 42. In the preferred embodiment of the invention depicted in the drawings, knock-out center piece 42 includes a substantially circular perimeter which is coupled at spaced apart intervals to the upper, interior edge of circular body 22.

Knock-out center piece 42 may also be configured to include a finger hole 44 which is disposed in proximity to the perimeter of knock-out center piece 42. The finger hole may have any one of the variety of different geometric configurations, although the semi-circular aperture configuration depicted in the drawings best facilitates entry of a user's finger and therefore best facilitates the gripping and removal of knock-out center piece 42 by a user.

Knock-out center piece 42 serves to substantially cover the entire, otherwise open upper surface of cylindrical container 12 until the contents of the container is ready for use. With paint cans, the container lid will typically be removed at a central location such as a painter's vehicle or at a central storage area; the sealing groove cover 10 of the present invention will typically be installed at that time and location. The paint container may subsequently be transported to the actual job site, for example, the top of a ladder or in a different room. Only at or near that time should the user grasp the finger hole 44 and remove the knock-out center piece 42. Thus, between the initial installation of the sealing groove cover 10 on the container and the time when knock-out center piece 42 is subsequently removed, the fluid or paint contents of the container are prevented from being contaminated by dust, dirt or other undesirable particulate matter which could render the paint or other fluid unusable. In addition, the fact that knock-out center piece 42 forms a nearly complete seal over the top of the paint container, container spills will not result in a substantial loss of its fluid content during the time before knock-out center piece 42 has been removed from container 12.

The sealing groove cover 10 of the present invention is typically fabricated from a bendable plastic material which facilitates torsional bending without breaking during the upwardly spiralling removal motion illustrated in FIG. 6. This unique configuration of the present invention requires that the user exert only the minimal force required to unseat and remove the moving small, piece-wise segment of the cover where the circular body 22 and male element 38 are being lifted out of the container female groove. In virtually all prior art devices intended to accomplish a comparable purpose, a user must exert a substantially greater force to remove or unseat the entire circumference of the male element of the sealing cover from the entire circumference of the female groove of a cylindrical container.

In the present invention, the gap 28 between first end 24 and second end 26 of circular body 22, the unique configurations and placement of pull tab 40, together with the fabrication of the entire sealing groove cover from a bendable material such as plastic facilitates the unique spiral, unwinding removal configuration of the present invention as depicted in FIG. 6.

Figure 5:
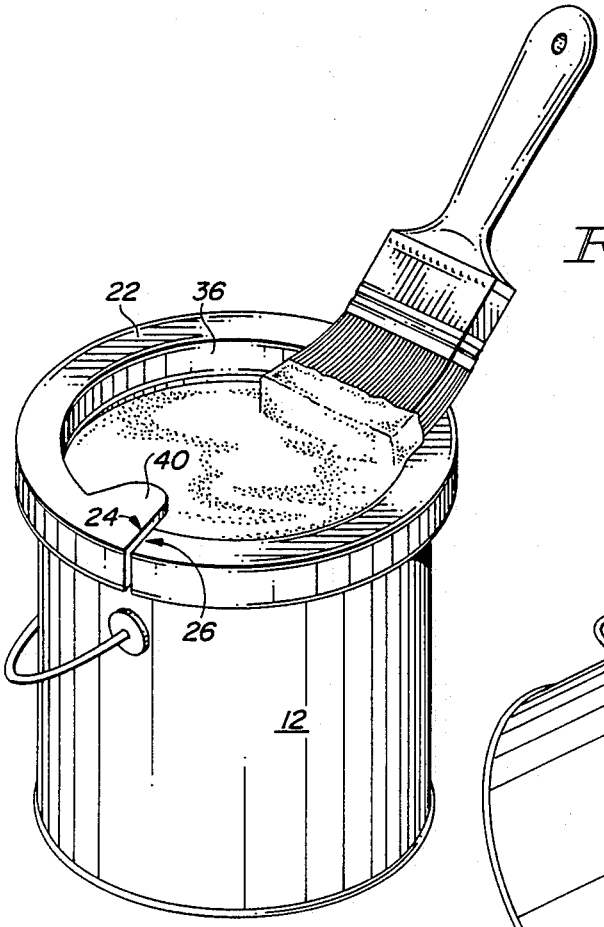
FIG. 5 depicts the sealing groove cover of the present invention installed on a cylindrical paint container and illustrates the manner in which the interior edge of the sealing groove cover can be used to remove excess paint from a paint brush.
Figure 7:
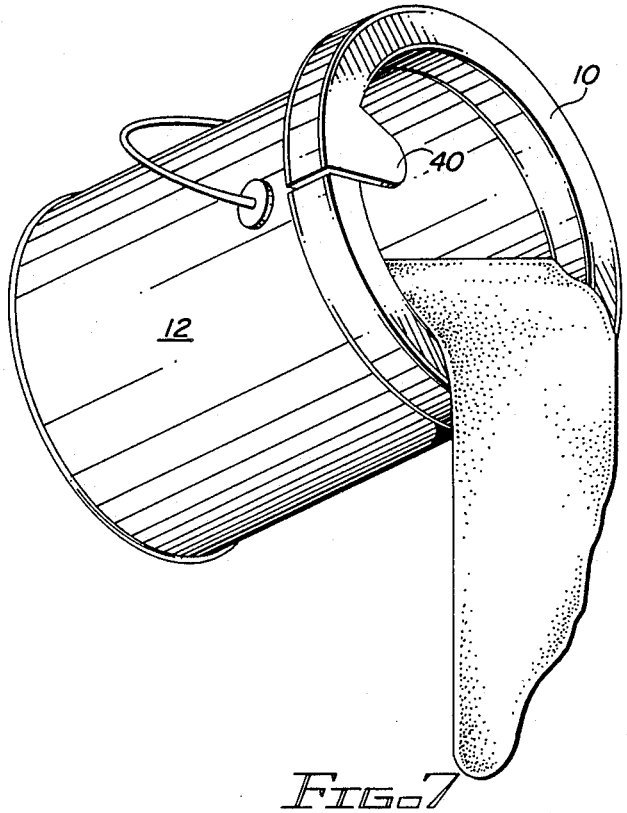
FIG. 7 represents a perspective view of the sealing groove cover as installed on a paint container illustrating paint being poured over the sealing groove cover out of the paint container.

FIG. 5 illustrates the manner in which the configuration of the sealing groove cover 10 of the present invention facilitates removal of excess paint from a paint brush. FIG. 7 illustrates the manner in which the sealing groove cover 10 of the present invention completely prevents fluid contamination of any of the upper sealing surface of the fluid container 12, especially the recessed female groove 16, as paint or other fluid contents are poured out from the interior of container 12.

The substantially flat or planar configuration of knock-out center piece 42 of the present invention enables a vendor to place an advertising message, a trademark, graphics or other printed material such as instructions, directions or warnings on the comparatively large exposed upper surface of knock-out center piece 42. If the sealing groove cover 10 of the present invention is intended to be used as a promotional item or advertising device, this aspect of the present invention represents a significant advantage. The segmented interconnection between the perimeter of knock-out center piece 42 and the interior edge of the sealing groove cover 10 of the present invention facilitates simple, low effort removal of knock-out center piece 42 from the sealing groove cover 10 at the appropriate time.

Because of the comparatively simple, uncomplicated structural configuration of the sealing groove cover 10 and the fact that it may be manufactured from a bendable material such as plastic, the sealing groove cover 10 may be fabricated at very low cost which represents a significant user benefit.

It will be apparently to those skilled in the art that the sealing groove cover of the present invention may be modified in numerous way and may assumed many embodiments other than the preferred forms specifically set out and described abover. For example, it is not required that the upper surface of circular body 22 be fabricated as a linear or flat surface as depicted, nor it is necessary that the outer or inner sealing members 34 and 36 be configured with flat or linear edges as shown. Various other different configurations and embodiments of the sealing groove cover of the present invention would be immediately apparent to one of ordinary skill in the art. Accordingly, it is intended by the appended claims to cover all such modifications of the invention which fall within the true spirit and scope of the invention.

I claim:

1. A sealing groove cover for a cylindrical container having a center, an open top, a bottom, a vertically oriented cylindrical side wall with inner and outer surfaces, the container further including a continuous circular female groove disposed within the container side wall and having an outer perimeter coupled to the top of the side wall and an inner perimeter, the female groove serving to secure and seal a removable lid having a complementary circular male element to the top of the container, the sealing groove cover comprising:

a. a circular body fabricated from a bendable material and having a first end, a second end terminating in proximity to the first end and defining a gap between the first and second ends, the circular body further including an inner perimeter edge and an outer perimeter edge;

b. a circular outer sealing member fabricated from bendable material and coupled to the circular body along the outer perimeter edge, the outer sealing member being dimensioned to snugly contact the outer surface of the container side wall;

c. a circular inner sealing member fabricated from bendable material and coupled to the circular body along the inner perimeter edge, the inner sealing member being dimensioned to snugly contact the inner perimeter of the female groove; and d. a circular male element fabricated from a bendable material and projecting outward from the circular body at a radial distance between the inner and outer sealing members in alignment with the female groove of the container for forming an interference fit between the sealing groove cover and the container female groove, the body, the inner and outer sealing members and the male element deflecting without breaking as the first and second ends of the circular body are displaced relative to each other by upward lifting forces and whereby the sealing groove cover prevents contaminating fluids or particulate matter from entering the female groove of the container when the lid is removed from the container.

2. The sealing groove cover of claim 1 further including a pull tab coupled in proximity to the first end of the circular body.

3. The sealing groove cover of claim 2 wherein the pull tab is coupled to the circular body with an elevation even with or above the top of the container.

4. The sealing groove cover of claim 3 wherein the circular body includes a flat, horizontally oriented upper surface.

5. The sealing groove cover of claim 4 wherein the pull tab represents a flat, horizontally oriented surface.

6. The sealing groove cover of claim 5 wherein the flat horizontally oriented upper surface of the pull tab is vertically aligned with the flat, horizontally oriented surface of the circular body.

7. The sealing groove cover of claim 3 wherein the pull tab is coupled to the inner sealing member and extends inward toward the center of the container.

8. The sealing groove cover of claim 7 wherein the circular body includes a flat, horizontally oriented upper surface, the pull tab includes a flat, horizontally oriented upper surface and the upper surfaces of the pull tab and circular body are vertically aligned.

9. The sealing groove cover of claim 1 further including a knock-out center piece coupled at spaced apart intervals to the circular body.

10. The sealing groove cover of claim 9 wherein the knock-out center piece includes a substantially circular perimeter.

11. The sealing groove cover of claim 10 wherein the knock-out centerpiece further includes a finger hole disposed in proximity to the perimeter of the center piece.

12. The sealing groove cover of claim 11 wherein the finger hole is formed in the configuration of an oval-shaped aperture.

13. The sealing groove cover of claim 10 further including a pull tab coupled in proximity to the first end of the circular body.

14. The sealing groove cover of claim 13 wherein the circular body includes a flat, horizontally oriented upper surface, the pull tab includes a flat, horizontally oriented upper surface and the upper surfaces of the pull tab and circular body are vertically aligned.

15. The sealing groove cover of claim 14 wherein the perimeter of the knock-out center piece is inwardly contoured in proximity to the pull tab to avoid interference with the inwardly projecting pull tab.

16. The sealing groove cover of claim 15 wherein the knock-out center piece is fabricated from a layer of thin plastic.

17. The sealing groove cover of claim 1 wherein the circular inner and outer sealing members extend vertically downward from the circular body and conform to the cylindrical contour of the cylindrical container.

18. The sealing groove cover of claim 17 wherein the circular inner and outer sealing members include flat interior and exterior side walls.

19. The sealing groove cover of claim 1 wherein the bendable material comprises plastic.

20. The sealing groove cover of claim 19 wherein the plastic material comprises a semi-rigid plastic material.

* * * * *